US011440725B2

(12) United States Patent
Lezama Villagomez

(10) Patent No.: US 11,440,725 B2
(45) Date of Patent: Sep. 13, 2022

(54) SHOT GLASS SHAKER COMBINATION

(71) Applicant: Jose Guadalupe Lezama Villagomez, Hollister, CA (US)

(72) Inventor: Jose Guadalupe Lezama Villagomez, Hollister, CA (US)

( * ) Notice: Subject to any disclaimer, the term of this patent is extended or adjusted under 35 U.S.C. 154(b) by 321 days.

(21) Appl. No.: 16/846,162

(22) Filed: Apr. 10, 2020

(65) Prior Publication Data

US 2021/0316932 A1 Oct. 14, 2021

(51) Int. Cl.

| | |
|---|---|
| ***B65D 81/36*** | (2006.01) |
| ***A47G 19/22*** | (2006.01) |
| ***A47G 19/24*** | (2006.01) |
| ***B65D 47/12*** | (2006.01) |
| ***B65D 39/02*** | (2006.01) |

(52) U.S. Cl.

CPC ..... *B65D 81/36* (2013.01); *A47G 19/2205* (2013.01); *A47G 19/24* (2013.01); *B65D 39/025* (2013.01); *B65D 47/12* (2013.01); *B65D 2251/0025* (2013.01); *B65D 2251/0093* (2013.01)

(58) Field of Classification Search

CPC ..... B65D 51/18; B65D 2251/0003; B65D 43/0295; B65D 2543/00277; B65D 2543/00555; B65D 2543/00546; B65D 2401/15; B65D 2543/00509; B65D 2543/00537; B65D 2543/00092

See application file for complete search history.

(56) References Cited

U.S. PATENT DOCUMENTS

| | | | | | |
|---|---|---|---|---|---|
| 553,580 | A * | 1/1896 | Frye | A47G 19/24 | 222/142.1 |
| 700,534 | A * | 5/1902 | Moller | A47G 19/24 | 29/451 |
| 1,139,147 | A * | 5/1915 | West | B65D 47/06 | D7/591 |
| 1,298,313 | A * | 3/1919 | Ebeling | B65D 41/0442 | 215/337 |
| 2,695,732 | A * | 11/1954 | Tupper | A47G 19/24 | 222/480 |
| 2,795,357 | A * | 6/1957 | Burton | A47G 19/24 | 211/1 |
| 3,485,416 | A * | 12/1969 | Fohrman | A47G 19/24 | D9/503 |
| 3,635,470 | A * | 1/1972 | McMillan | A63H 37/00 | 472/51 |
| 4,387,803 | A * | 6/1983 | Mercil | A47J 47/06 | 206/204 |

(Continued)

*Primary Examiner* — Kareen K Thomas

(74) *Attorney, Agent, or Firm* — Donald R. Boys; Central Coast Patent Agency LLC

(57) ABSTRACT

A beverage product has a shot glass having an upper rim with an outside diameter, a quantity of a beverage in the shot glass, a substantially circular peel-off sealing element adhered by adhesive to the upper rim of the shot glass, retaining the beverage in the shot glass, and a shaker lid having a matrix of openings for dispensing salt, pepper or other material, the shaker lid assembled over the upper rim of the shot glass. A user purchasing the product removes the shaker lid, peels off the substantially circular peel-off sealing element, consumes the beverage, places salt, pepper or other material in the emptied shot glass and reattaches the shaker lid, rendering the combination as a salt or pepper shaker.

5 Claims, 7 Drawing Sheets

(56) References Cited

U.S. PATENT DOCUMENTS

| | | | | | |
|---|---|---|---|---|---|
| 4,683,016 | A * | 7/1987 | Dutt | B29C 66/112 | 264/249 |
| 4,706,802 | A * | 11/1987 | Leigh | C11D 17/047 | 206/0.5 |
| 4,896,653 | A * | 1/1990 | Eke | A47J 36/30 | 126/45 |
| 5,145,097 | A * | 9/1992 | Lowe | A47G 19/24 | 222/565 |
| 2005/0279653 | A1* | 12/2005 | Williams-Lucas | B65D 51/285 | 206/219 |
| 2017/0020783 | A1* | 1/2017 | Shani | B65D 77/0493 | |
| 2019/0193891 | A1* | 6/2019 | Livesley-James | B65D 17/02 | |

* cited by examiner

SHOT GLASS SHAKER COMBINATION

BACKGROUND OF THE INVENTION

1. Field of the Invention

The present invention is in the technical field of containers for beverages and pertains more particularly to a tall shot glass with an alcoholic beverage, and a top to convert to a salt or pepper shaker.

2. Description of Related Art

Shot glasses are well-known in the art. Shot glasses that may be filled with an alcoholic beverage and sealed such that the filled and sealed glass may be marketed as a separate product are less well-known. A shot glass that is filed and sealed, and combined with a removable top that is adapted as a dispenser for salt or pepper, or both, is not known by the inventor to be known in the art.

BRIEF SUMMARY OF THE INVENTION

In one embodiment of the invention, a beverage product is provided, comprising a shot glass having an upper rim with an outside diameter, a quantity of a beverage in the shot glass, a substantially circular peel-off sealing element adhered by adhesive to the upper rim of the shot glass, retaining the beverage in the shot glass, and a shaker lid having a matrix of openings for dispensing salt, pepper or other material, the shaker lid assembled over the upper rim of the shot glass. A user purchasing the product removes the shaker lid, peels off the substantially circular peel-off sealing element, consumes the beverage, places salt, pepper or other material in the emptied shot glass and reattaches the shaker lid, rendering the combination as a salt or pepper shaker.

In one embodiment of the product, the shot glass is a tall tequila shot glass, and the beverage is tequila. Also, in one embodiment the shaker lid has a domed top. In one embodiment the shot glass has a horizontal outward protuberance at the upper rim, the shaker lid has a descending skirt having an opening at the bottom smaller in diameter than the outside diameter of the upper rim of the shot glass, and a groove on the inside wall adapted to capture the protuberance of the upper rim of the shot glass, such that pressing the shaker lid downward onto the shot glass snaps the shaker lid into place by the groove. And in one embodiment the descending skirt is separated into a plurality of individual tabs.

In one embodiment the substantially circular peel-off sealing element is adhered by an adhesive of a first strength to an undersurface of the shaker lid and by an adhesive of a lesser strength than the first strength to the upper rim of the shot glass, such that removing the shaker lid also peels the substantially circular peel-off element from the upper rim of the shot glass, exposing the beverage to be consumed.

In another aspect of the invention a method for producing a beverage product is provided, comprising filling a shot glass having an upper rim with an outside diameter with a quantity of a beverage, sealing the beverage in the shot glass by application of a substantially circular peel-off sealing element with an adhesive to an upper rim of the shot glass, and joining a shaker lid having a matrix of openings for dispensing salt, pepper or other material to the sealed shot glass containing the beverage.

In one embodiment of the method, in the filling step, a tall tequila shot glass is filled with tequila. Also, in one embodiment, in the step of joining the shaker lid to the shot glass, a descending skirt of the shaker lid is pressed over the upper rim of the shot glass, and an outward protuberance of the upper rim of the shot glass is captured in a groove on an inside wall of the descending skirt of the shaker lid. In one embodiment separate tabs are formed in the descending skirt of the shaker lid by upward slots in the descending skirt from the bottom of the descending skirt.

In one embodiment of the method, in the step of sealing the beverage in the shot glass, the substantially circular sealing element is first joined to a circular surface under the shaker lid by an adhesive of a first strength, and the substantially circular sealing element is joined to the upper rim of the shot glass by an adhesive of a second strength, lesser then the first strength, in the act of pressing the shaker lid onto the shot glass, and removal of the shaker lid from the shot glass peels the substantially circular sealing element from the shot glass by virtue of the adhesive of lesser strength, leaving the substantially circular sealing element adhered to the underside of the shaker lid.

And in one embodiment of the method, the user removes the shaker lid, that also peels off the substantially circular sealing element from the upper rim of the shot glass, consumes the beverage, peels the substantially circular sealing element from the underside of the shaker lid, and replaces the shaker lid on the shot glass, creating a salt or a pepper shaker.

DETAILED DESCRIPTION OF THE INVENTION

Figure 1:
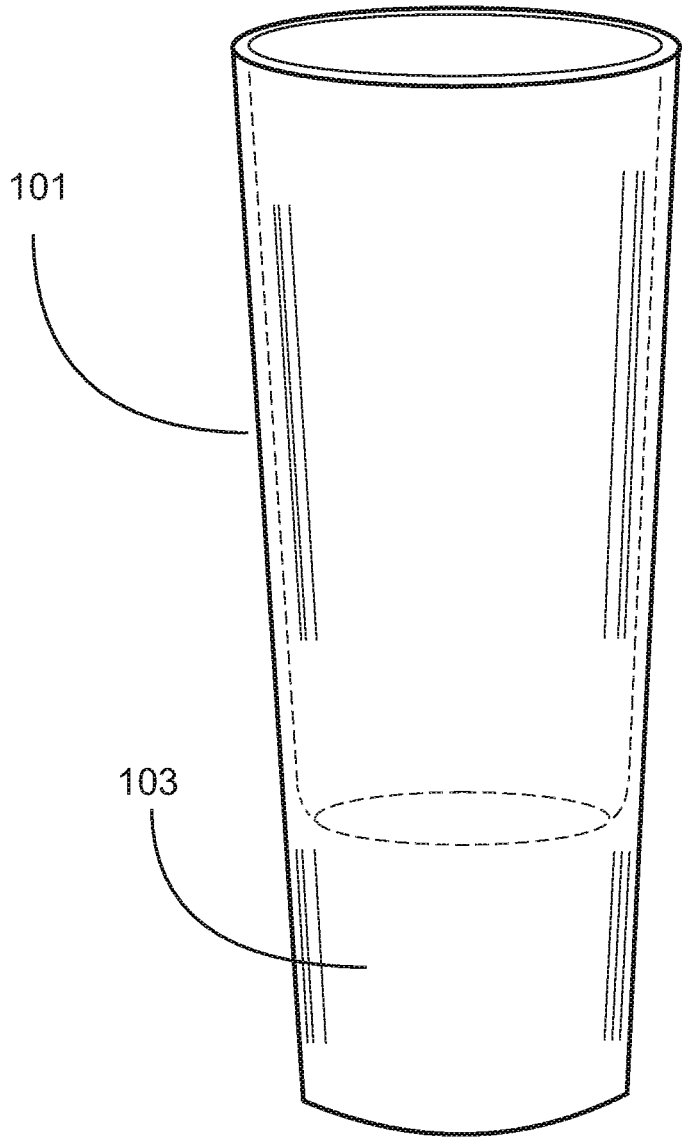
FIG. 1 is a perspective view of a tall shot glass associated with tequila.

FIG. 1 is a perspective view of a tall shot glass 100 associated with tequila. Glasses of this sort in the art are known to conform at least approximately to standard dimensions, and typically have a relatively thick base 103 which may help stabilize the shot glass in use. These glasses in the art are also quite often annotated with names and artwork. Some are etched on the outside surface. The different sorts of indicia and surface treatments are quite extensive.

Figure 2:
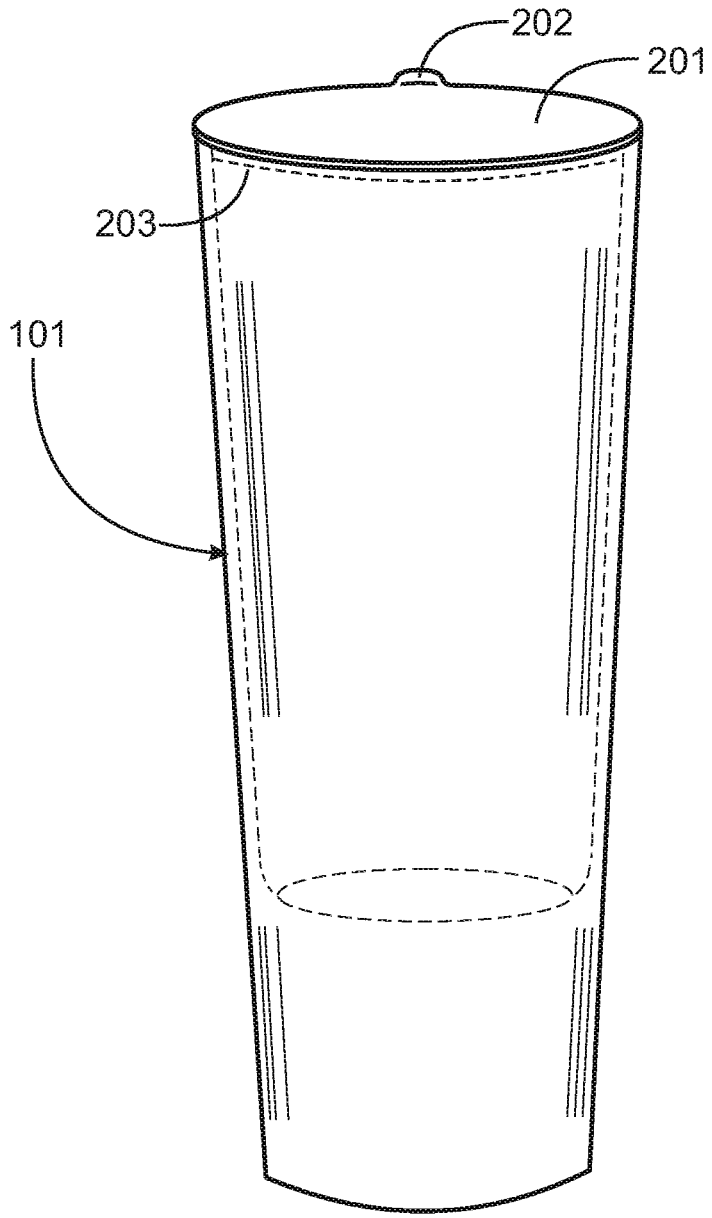
FIG. 2 is a perspective view of the shot glass of FIG. 1 filled with a beverage and having a top seal.

FIG. 2 illustrates shot glass 101 of FIG. 1 filled and sealed in an embodiment of the invention. Dotted line 203 is to represent the top surface od a beverage, such as tequila, in the glass. A peel-off seal 201 is sealed to the rounded top rim of glass 101 in this example. The sealant is an adhesive known to be safe for sealing beverage containers, and in this case to be resistant to ethyl alcohol in a beverage in the glass.

The material of the seal may be paper, metallic foil or any of several kinds of plastic as are known in the art.

Peel-off seal 201 in this example has a tab 202 that a user may grasp to peel seal 201 from the upper lip of glass 101. This tab may be of about any convenient size, and there may in some circumstances be more than one such tab.

Figure 3:
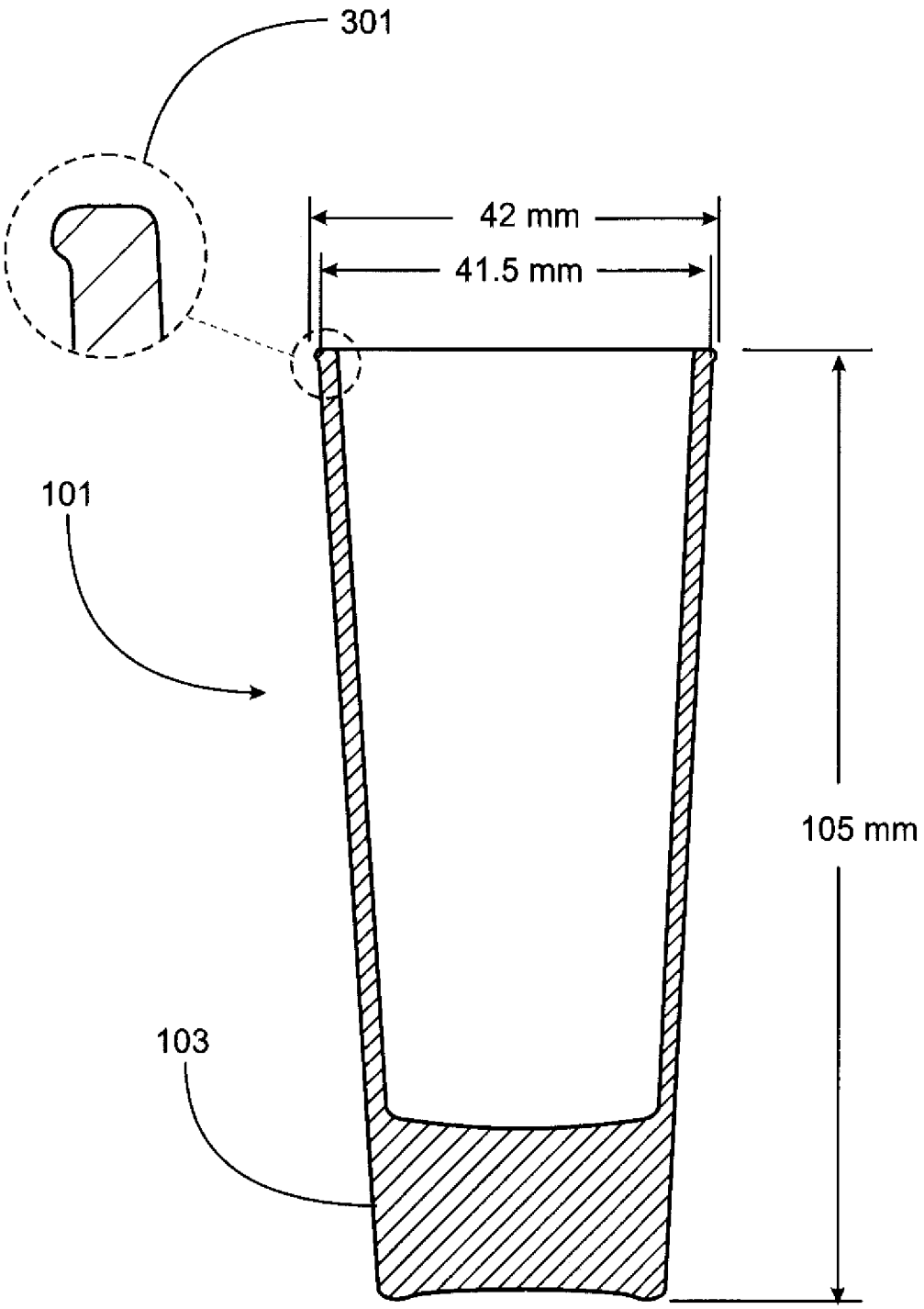
FIG. 3 is a section view of the shot glass of FIG. 1, with some approximate dimensions.

FIG. 3 is a section view of shot glass 101 of FIG. 1, with some approximate dimensions. In this example the height of the glass is 105 mm, and the outside diameter of the upper rim is 42 mm. View 301 is a magnified view of the upper rim on one side, showing that there is a rounded lip with a smaller diameter just under the lip. In this example the smaller diameter is 41.5 mm, which determines that the lip extends on one side by 0.25 mm, which in English measurement is about ten one-thousands of an inch. This quite a small dimension and is exaggerated in FIG. 3 to emphasize the fact of the shape of the lip. In one embodiment of the present invention this rounded lip is exploited for a purpose of the invention.

It is to be understood that not every shot glass of the sort depicted in FIGS. 1, 2 and 3 have dimensions that are exactly the same. The inventor, having measured several such glasses with an electronic digital caliper has discovered that there are dimensional differences among glasses made by different manufacturers, and even among different groups of glasses made by a same manufacturer. Be that as it may, they all have the slight outward protuberance of the upper lip.

Figure 4:
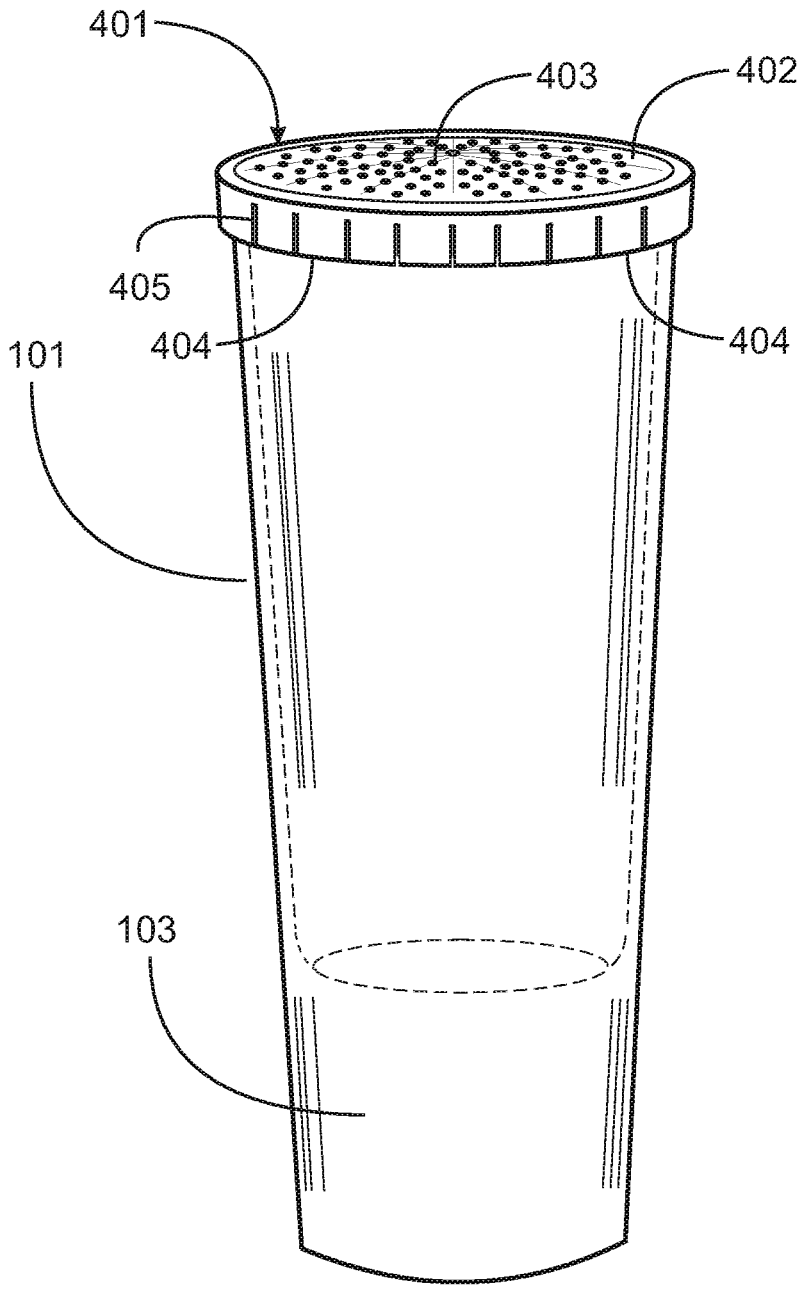
FIG. 4 is a perspective view of a shot glass like that of FIGS. 1-3, with a salt-shaker lid in place in an embodiment of the present invention.

FIG. 4 is a perspective view of a shot glass like that of FIGS. 1-3, with a salt-shaker lid 401 in place in an embodiment of the present invention. Lid 401 has a somewhat convex dome 402, so as to not interfere with a seal 201 as seen in FIG. 2 and has a pattern of openings 403 that are sized for dispensing salt. Lid 401 is especially adapted to fit onto the upper rim of shot glass 101 by individual flexible clips 404 in this example. Clips 404 may in some embodiments be implemented by cutting upward through the descending rim of the lid as shown at 405.

Figure 5A:
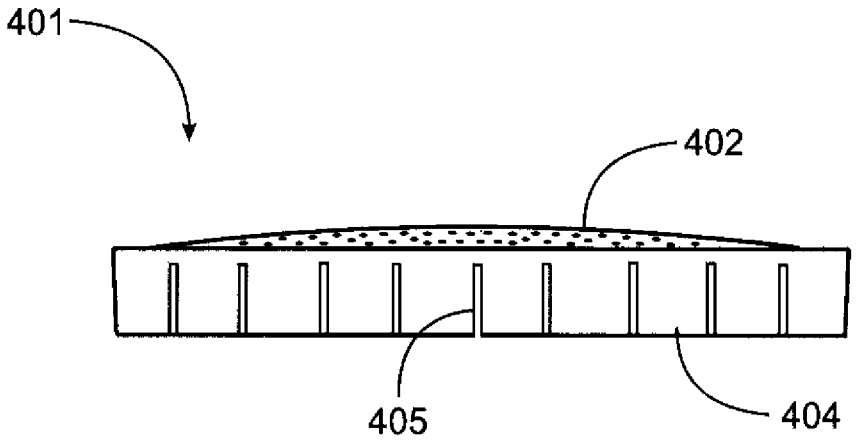
FIG. 5A is a side view of the salt-shaker lid of FIG. 4.
Figure 5B:
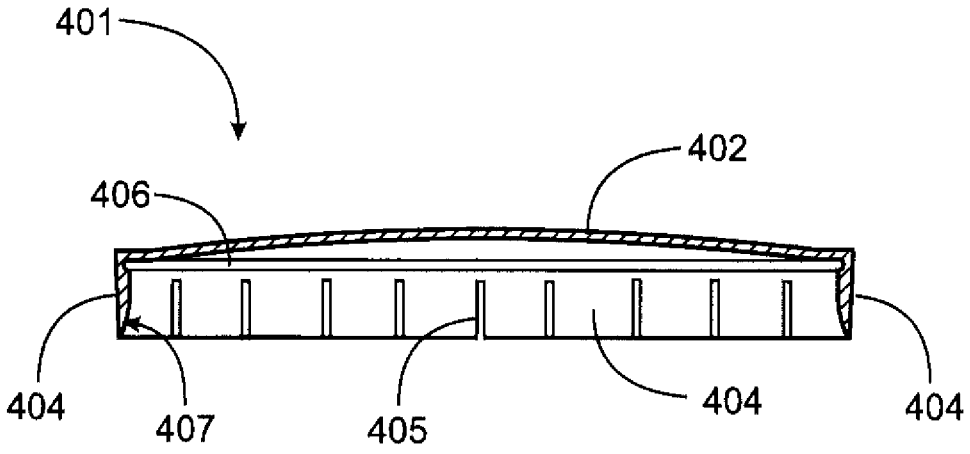
FIG. 5B is a section view of the salt-shaker lid of FIG. 4.

FIG. 5A is a side elevation view of lid 401 illustrating for example that convex dome 402 extends above the rim of the lid. FIG. 5B is a section view of lid 401 taken along a vertical plane through the center of the lid. The section view shows the outermost tabs 404 in this view in section, illustrating a chamfered lead-in 407 that serves to flex the tabs outward as a user presses down on a lid to assemble the lid to a shot glass, and a circumferential shallow groove 406 molded on the inside of the lid. The outwardly extending lip of the shot glass, measured to be about 0.010 inch, is captured in this groove as a lid is pressed into place on the shot glass, securing the shaker lid in place.

Figure 6A:
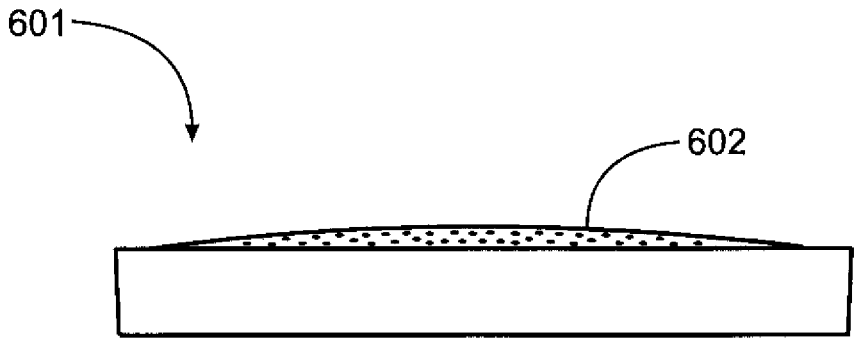
FIG. 6A illustrates a salt-shaker lid integrated with a peel-off seal for a shot glass.
Figure 6B:
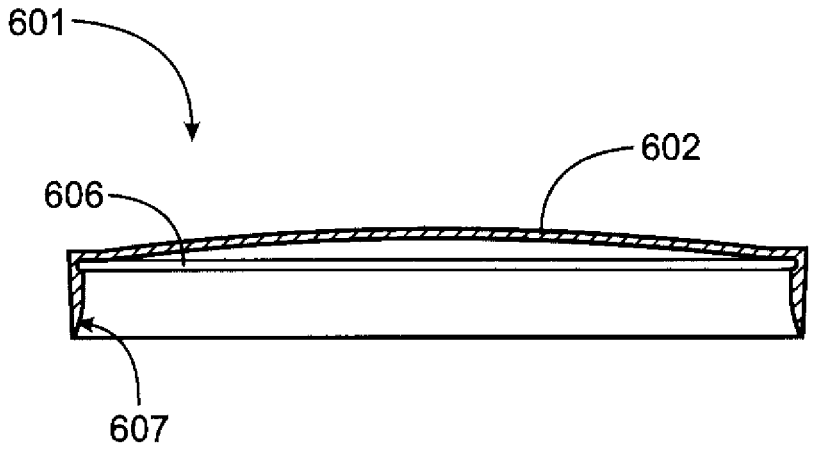
FIG. 6B is a section view of the lid of FIG. 6A.

FIGS. 6A and 6B illustrate a lid in an alternative embodiment in which there are no separate tabs and no cuts in the lid to implement such tabs. Lid 601 still has a chamfered lead-in 607 and an inside circumferential groove 606 to capture the lip of the upper rim of the shot glass. In the section view FIG. 6B the depth of the circumferential groove is exaggerated, and this groove need not in some implementations be more than about 0.005 inches deep. At that depth the groove would not actually show on the scale of FIG. 6B.

Referring back again to FIG. 4, it will be understood that with a lid like that of FIG. 6A and FIG. 6B, there will be no cut lines in the lid. In one embodiment of the invention a process of the invention proceeds as follows. Firstly, shot glasses are cleaned, ten filled with an alcoholic beverage. I a preferred embodiment the alcoholic beverage is a high-quality tequila. Once filled, the filled glasses are sealed with a peel-off seal by adhesive as is known in the art, typically leaving a tag shown as tag 202 in FIG. 2. After filling and sealing, a shaker cap of the sort depicted in FIGS. 4, 5A, 5B, 6A and 6B is pressed onto the glass and captured by the protruding lip of the glass. The filled glasses with lids may be packaged for distribution and sale. A user may remove the shaker lid, remove the seal 201 by tab 202, and consume the alcoholic beverage. Then the glass may be cleaned, filled with salt or pepper, or even another material that a user may want to dispense, the lid replaced, and the glass becomes, with the lid, a salt shaker or a pepper shaker.

Figure 7A:
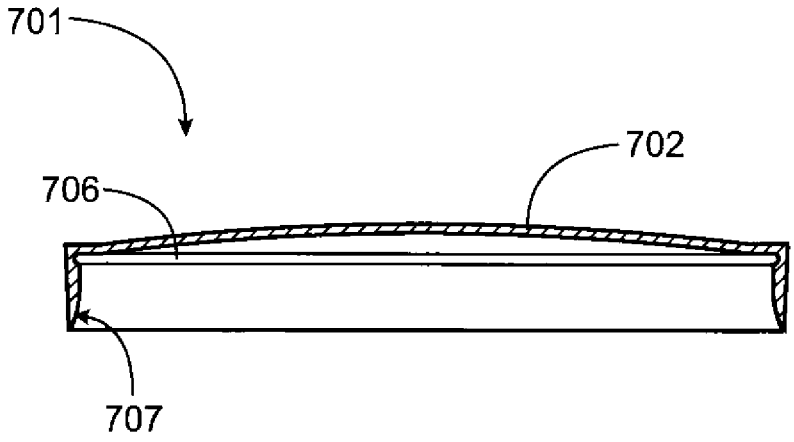
FIG. 7A is a section view of a lid with a sealing element integrated with the lid and applied by applying the lid.
Figure 7B:
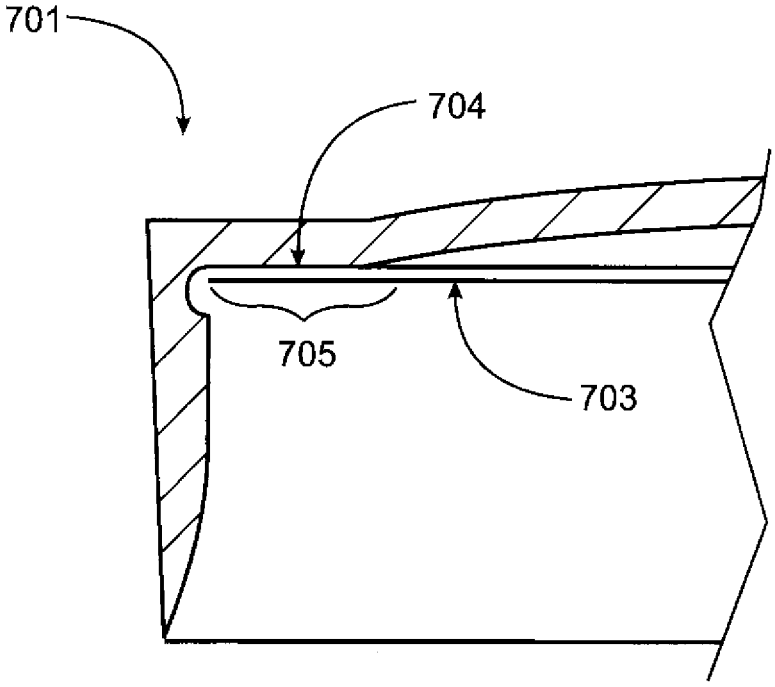
FIG. 7B is an enlarged view of the lid of FIG. 7A.

FIG. 7A illustrates another lid 701 in yet another embodiment of the invention. FIG. 7B is an enlarged view of a portion of the lid of FIG. 7A. In this embodiment the lid is the same as shown and described with reference to FIGS. 6A and 6B. A seal 703 like peel-off seal 201 of FIG. 2, without tab 202, is prepared and inserted into the underside of lid 701 as shown in FIG. 7B. Prior to insertion an adhesive is applied either to a top side of seal 703 or to surface 704 on the underside of lid 701, or both. Seal 703 has adhesive on the underside where the seal will meet the upper lip of the shot glass. Seal 703 is inserted into the underside of the lid and seals to the lid. Then the lid is assembled to the shot glass with the seal in place on the lid, and the seal in the lid seals the shot glass to retain the alcoholic beverage.

The adhesive applied to the upper side of the seal to adhere to the underside of the lid, or to the underside of the lid to capture the seal in the lid, is a stronger adhesive than the adhesive of the seal that adheres to the upper rim of the shot glass. Therefore, when the lid is removed by a user who has purchased a shot glass with the lid, the seal stays with the lid, and is pilled from the upper rim of the shot glass. The seal may later be removed from the inside of the lid, so the lid may be reapplied to render the shot glass, with the lid, as a salt or a pepper shaker.

A person with skill in the art will understand that the embodiments described in this document are exemplary only, and not limiting to the scope of the invention. Embodiment of the invention may be implemented using any of the examples described, or any combination of the examples described. The scope of the invention is limited only by the breadth of the claims.

The invention claimed is:

1. A beverage product combination, comprising:

a shot glass having an upper rim with a horizontal outward protuberance and an outside diameter;

a quantity of a beverage in the shot glass;

a substantially circular peel-off sealing element adhered by adhesive to the upper rim of the shot glass, retaining the beverage in the shot glass; and a shaker lid having a matrix of openings for dispensing salt, pepper or other material, a descending skirt having an opening at a bottom smaller in diameter than the outside diameter of the upper rim of the shot glass, and a groove on an inside wall adapted to capture a protuberance of the upper rim of the shot glass, such that pressing the shaker lid downward onto the shot glass snaps the shaker lid onto the shot glass by capturing the protruberance in the groove;

wherein a user purchasing the product removes the shaker lid, peels off the substantially circular peel-off sealing element, consumes the beverage, places salt, pepper or other material in an emptied shot glass and reattaches the shaker lid, rendering the combination as a salt or pepper shaker.

2. The product of claim 1 wherein the shot glass is a tall tequila shot glass, and the beverage is tequila.

3. The product of claim 1 wherein the shaker lid has a domed top.

4. The product of claim 1 wherein the descending skirt is separated into a plurality of individual tabs.

5. The product of claim 1 wherein the substantially circular peel-off sealing element is adhered by an adhesive of a first strength to an undersurface of the shaker lid and by an adhesive of a lesser strength than the first strength to the upper rim of the shot glass, such that removing the shaker lid also peels the substantially circular peel-off element from the upper rim of the shot glass, exposing the beverage to be consumed.

* * * * *